US009932823B2

(12) United States Patent
Silva et al.

(10) Patent No.: US 9,932,823 B2
(45) Date of Patent: Apr. 3, 2018

(54) DOWNHOLE SYSTEM HAVING SELECTIVE LOCKING APPARATUS AND METHOD

(71) Applicants: Zachary S. Silva, Houston, TX (US); James A. Smith, Manvel, TX (US)

(72) Inventors: Zachary S. Silva, Houston, TX (US); James A. Smith, Manvel, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 677 days.

(21) Appl. No.: 14/489,694

(22) Filed: Sep. 18, 2014

(65) Prior Publication Data

US 2016/0084027 A1 Mar. 24, 2016

(51) Int. Cl.
*E21B 23/00* (2006.01)
*E21B 47/09* (2012.01)

(52) U.S. Cl.
CPC ..... *E21B 47/09* (2013.01); *E21B 23/006* (2013.01); *E21B 23/004* (2013.01)

(58) Field of Classification Search
CPC . E21B 23/004; E21B 23/006; E21B 2034/007
See application file for complete search history.

(56) References Cited

U.S. PATENT DOCUMENTS 6,382,319 B1 5/2002 Hill, Jr. et al.
6,464,006 B2 10/2002 Womble et al.
7,543,647 B2 6/2009 Walker
7,997,344 B2 8/2011 Corbett
8,191,631 B2 6/2012 Clem et al.
2012/0048556 A1* 3/2012 O'Connell ..... E21B 23/006 166/308.1

(Continued)

OTHER PUBLICATIONS

George E. King Engineering; "Plugs and Profiles"; (2009) Retrieved online from GEKEngineering.com; 30 pages.

(Continued)

*Primary Examiner* — Waseem Moorad
*Assistant Examiner* — Christopher J Sebesta
(74) *Attorney, Agent, or Firm* — Cantor Colburn LLP

(57) ABSTRACT

A selective locking apparatus for an indicating tool, the selective locking apparatus includes a mandrel having a rotational collet finger receiving area including a plurality of unlocked-position tracks alternatingly arranged with a plurality of locked-position detents. A rotational collet rotatably supported on the mandrel, the rotational collet including a j-track on an outer periphery of the rotational collet, the rotational collet further including a plurality of rotational collet fingers having heads engageable within the rotational collet finger receiving area of the mandrel. An indicating collet supported on the mandrel, the indicating collet including a plurality of indicating collet fingers; and, at least one pin fixedly mounted on the indicating collet for receipt within the j-track of the rotational collet; wherein longitudinal movement of the mandrel with respect to the indicating collet cycles the rotational collet via j-track interaction and selectively places the heads of the rotational collet fingers into either the plurality of unlocked-position tracks or the plurality of locked-position detents. A method of selectively locking an indicating tool.

20 Claims, 9 Drawing Sheets

(56) References Cited

U.S. PATENT DOCUMENTS

| | | | | |
|---|---|---|---|---|
| 2013/0168099 | A1* | 7/2013 | Themig | E21B 34/103 166/308.1 |
| 2014/0014360 | A1* | 1/2014 | Wilson | E21B 21/103 166/373 |
| 2014/0124220 | A1* | 5/2014 | Stautzenberger | E21B 23/006 166/381 |
| 2016/0130897 | A1* | 5/2016 | Machocki | E21B 23/006 166/244.1 |

OTHER PUBLICATIONS

Haughton,et al. "Using Mutli-Function Fishing Tools Strings to Improve Efficiency and Economics of Deepwater Plug and Abandonment Operations"; (2001); AADE National Drilling Technical Conference 9 pages.

Schlumberger; Isolation Valves; (2009); 8 Pages.

* cited by examiner

DOWNHOLE SYSTEM HAVING SELECTIVE LOCKING APPARATUS AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

Deepwater completions require the use of indicating tools to identify tool port or seal position and prevent unwanted tool movement caused by tubing stretch, rig heave, etc. A common indicator for tool position is a hard boundary encountered by the indicating tool through interaction with a unique profile on the inner diameter of the outer string, which can allow for either setting down weight or pulling on the rental string while the indicating tool is in a locate mode. Manipulation of the indicating tool with an associated profile can be used to cycle the indicating tool to a "snap thru mode" enabling the rental string to pass beyond the indicating profile. For multi-zone systems, this produces the need to indicate on and cycle through each profile of each subsequent zone, resulting in excess string manipulation when passing through or between zones.

The art would be receptive to alternative devices and methods for improved manipulation of indicating tools.

BRIEF DESCRIPTION

A selective locking apparatus for an indicating tool, the selective locking apparatus includes a mandrel having a rotational collet finger receiving area including a plurality of unlocked-position tracks alternatingly arranged with a plurality of locked-position detents; a rotational collet rotatably supported on the mandrel, the rotational collet including a j-track on an outer periphery of the rotational collet, the rotational collet further including a plurality of rotational collet fingers having heads engageable within the rotational collet finger receiving area of the mandrel; an indicating collet supported on the mandrel, the indicating collet including a plurality of indicating collet fingers; and, at least one pin fixedly mounted on the indicating collet for receipt within the j-track of the rotational collet; wherein longitudinal movement of the mandrel with respect to the indicating collet cycles the rotational collet via j-track interaction and selectively places the heads of the rotational collet fingers into either the plurality of unlocked-position tracks or the plurality of locked-position detents.

A method of selectively locking an indicating tool, the method includes attaching the selective locking apparatus of a selective locking apparatus for an indicating tool, the selective locking apparatus includes a mandrel having a rotational collet finger receiving area including a plurality of unlocked-position tracks alternatingly arranged with a plurality of locked-position detents; a rotational collet rotatably supported on the mandrel, the rotational collet including a j-track on an outer periphery of the rotational collet, the rotational collet further including a plurality of rotational collet fingers having heads engageable within the rotational collet finger receiving area of the mandrel; an indicating collet supported on the mandrel, the indicating collet including a plurality of indicating collet fingers; and, at least one pin fixedly mounted on the indicating collet for receipt within the j-track of the rotational collet; wherein longitudinal movement of the mandrel with respect to the indicating collet cycles the rotational collet via j-track interaction and selectively places the heads of the rotational collet fingers into either the plurality of unlocked-position tracks or the plurality of locked-position detents; to the indicating tool, wherein the mandrel of the selective locking apparatus supports the indicating tool.

BRIEF DESCRIPTION OF THE DRAWINGS

The following descriptions should not be considered limiting in any way. With reference to the accompanying drawings, like elements are numbered alike.

DETAILED DESCRIPTION

Figure 1A:
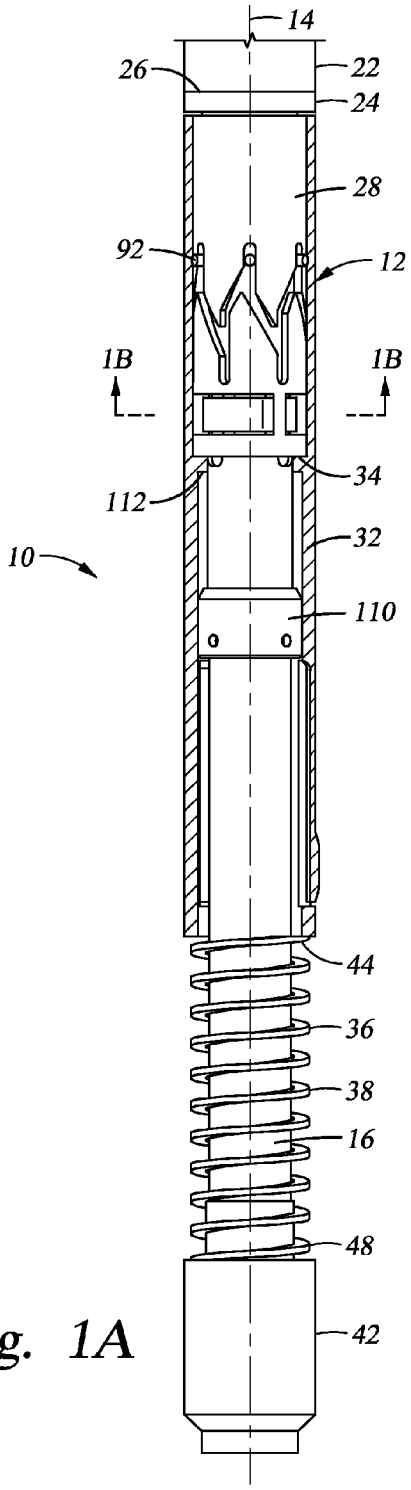
FIGS. 1A-1C depict views of an exemplary embodiment of a downhole system in an unlocked position.

A detailed description of one or more embodiments of the disclosed apparatus and method are presented herein by way of exemplification and not limitation with reference to the Figures.

As shown in FIGS. 1A-1C, 2A-2B, 3A-3C, and 4A-4B, an exemplary embodiment of a downhole system 10 having a selective locking apparatus 12 useful in downhole applications is shown. The downhole system 10 has a longitudinal axis 14, and includes a mandrel 16 having an uphole end 18 (FIGS. 5A-5C) and a downhole end 20. The mandrel 16 supports another tool that can be cycled between operational positions such as an indicating tool 22 thereon, and the indicating tool 22 may be supported by a support ring 24 at a downhole end 26 of the indicating tool 22. The indicating tool 22 is not shown in detail herein, and may be any indicating tool, such as one capable of performing an indicating function. The indicating tool 22 may include collet fingers (not shown) radially supported on upsets (not shown) on the mandrel 16 when in the indicating mode. Movement of the mandrel 16 to longitudinally remove the upsets relative to the collet fingers, such that the collet fingers are no longer supported by the upsets, allows the collet fingers to move radially inward into a "snap thru mode" to pass beyond an indicating profile. Downhole of the indicating tool 22 is the selective locking apparatus 12, also supported on the mandrel 16. A rotational collet 28 (further shown in FIGS. 6A-6C) of the selective locking apparatus 12 is rotatably supported, and therefore rotatably movable with respect to, the mandrel 16. The rotational collet 28 may also be partially supportable by the support ring 24 at an uphole end 30 of the rotational collet 28. An indicating collet 32 (further shown in FIGS. 8A-8B) is positioned radially exterior to the rotational collet 28. In an exemplary embodiment, the indicating collet 32 extends the length of the rotational collet 28, and further extends downhole a downhole end 34 of the rotational collet 28. The mandrel 16 further supports a biasing member 36, such as spring 38, around an exterior surface 40 of the mandrel 16. An adapter 42 is attached to the downhole end 20 of the mandrel 16, and the spring 38 includes an uphole end 44 abutting the downhole end 46 of the indicating collet 32, and a downhole end 48 of the spring 38 abutting the adapter 42. While a particular arrangement is described, it should be understood that some details are illustrative and may be altered without affecting the operation of the downhole system 10 and selective locking apparatus 12. For example, the mandrel 16 may be divided into multiple parts such that the selective locking apparatus 12 may be featured as an "add on" to an existing locking tool 22. As another example, the mandrel 16 may include a shoulder upon which the downhole end 48 of the spring 38 abuts instead of the adapter 42, and a movable ring may be positioned between the uphole end 44 of the spring 38 and the downhole end 46 of the indicating collet 32.

Figure 4A:
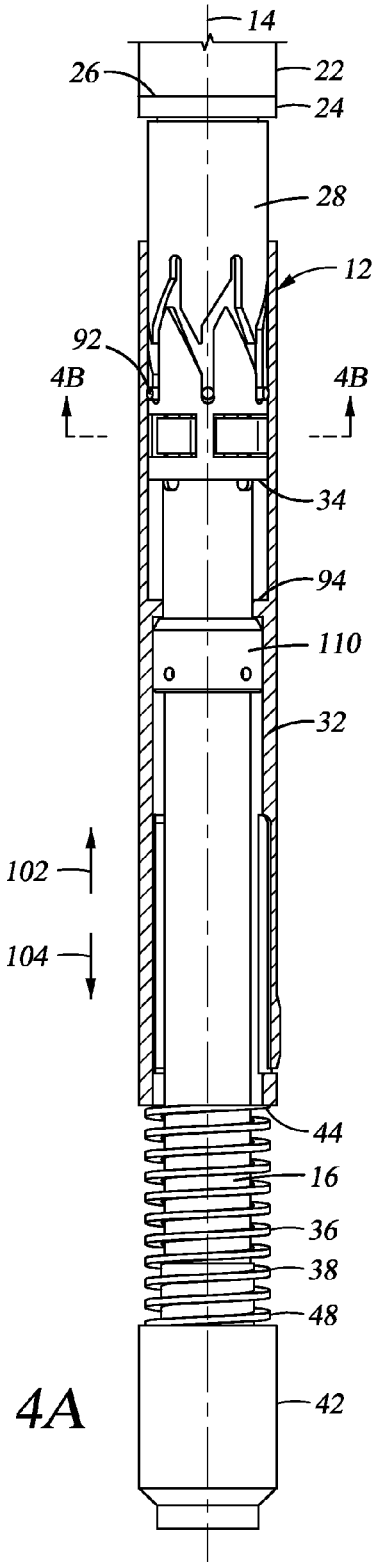
Figure 5A:
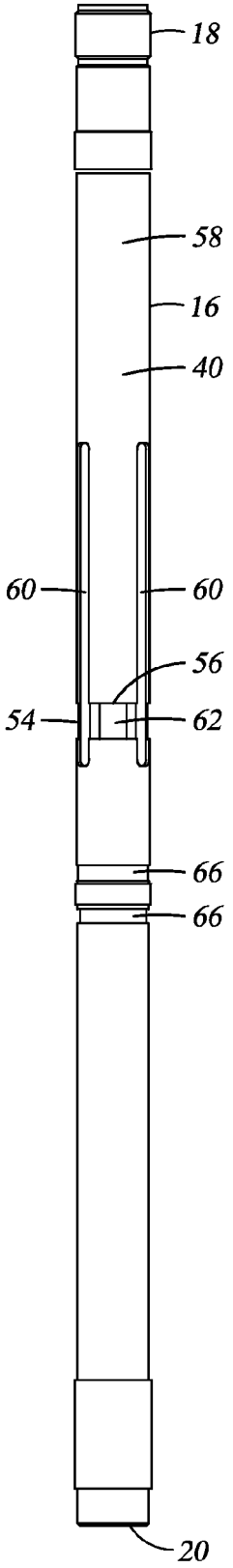
FIGS. 5A-5D depict views of an exemplary embodiment of a lower mandrel for use in the downhole system.
Figure 5B:
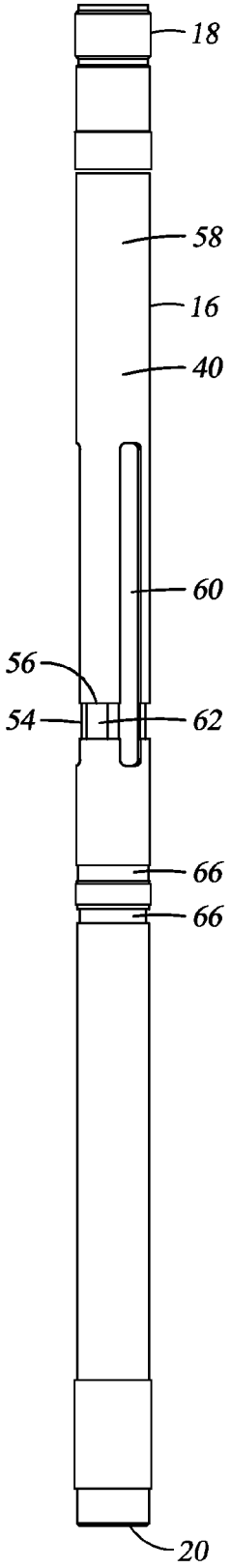
Figure 5C:
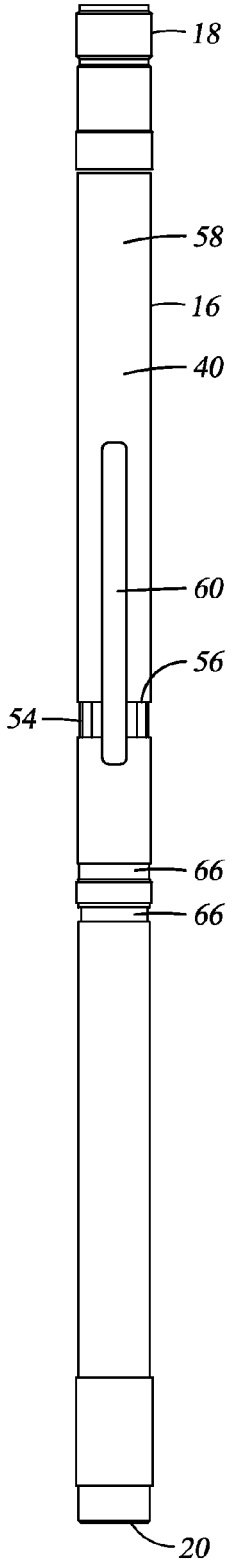
Figure 5D:
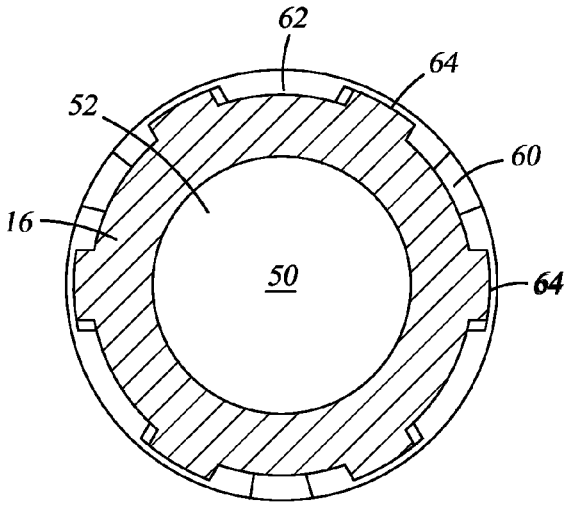

An exemplary embodiment of the mandrel 16 is shown in more detail in FIGS. 5A-5D. FIGS. 5A-5C show plan views of the mandrel 16 taken at three different rotations about the longitudinal axis 14, and FIG. 5D shows a cross-sectional view taken along line J-J in FIG. 5B. The mandrel 16 includes the uphole and downhole ends 18, 20, and a portion from the mandrel 16 in the area of the indicating tool 22 is not shown for clarity. The mandrel 16 shares the longitudinal axis 14 of the downhole system 10, and is generally cylindrical with a flow path 50 provided in an interior 52 of the mandrel 16. In the area where the rotational collet 28 is to be supported, the mandrel 16 includes a rotational collet finger receiving area 54, which includes a ring-shaped portion 56 that surrounds a periphery 58 of the mandrel 16. The rotational collet finger receiving area 54 includes a plurality of unlocked position tracks 60 alternatingly arranged with a plurality of locked position detents 62. For example, three tracks 60 and three detents 62 are shown indented into the exterior surface 40 of the mandrel 16. The tracks 60 and detents 62 are evenly spaced from each other with lands 64 there between. If three tracks 60 and three detents 62 are employed, then there would be six lands 64 as shown, and the tracks 60 would be arranged 120 degrees apart from each other, and the detents 62 would be arranged 120 degrees apart from each other. The tracks 60 extend longitudinally past the ring-shaped portion 56 of the rotational collet finger receiving area 54 in a direction parallel to the longitudinal axis 14 and have a longer axial length than the detents 62. The detents 62, however are limited to the ring-shaped portion 56 of the rotational collet finger receiving area 54, as further exemplified in FIG. 3C by the walls 63 of the detents 62. Downhole of the rotational collet finger receiving area 54 is one or more spaced ring-shaped grooves 66 indented circumferentially about the periphery 58 of the mandrel 16. The spring stop 110 (FIGS. 1A, 2A, 3A, 4A) acts as a stop for the indicating collet 32 to shoulder against via shoulder 112 (FIGS. 1A, 3A, 8B) when the indicating collet 32 has engaged its "unique" profile and compressed the spring 38/cycled the rotational collet j-track 68 (basically the opposite side of the stroke from the shoulder 94 (FIGS. 2A, 4A, 8B) at downhole end 34 of rotational collet 28). This hard shoulder 112 is needed because the axial force required to snap out the collet 32 is greater than the force required to compress the spring 38. The grooves 66 (FIGS. 5A-5C) may be used for positioning the lower spring stop 110.

Figure 6A:
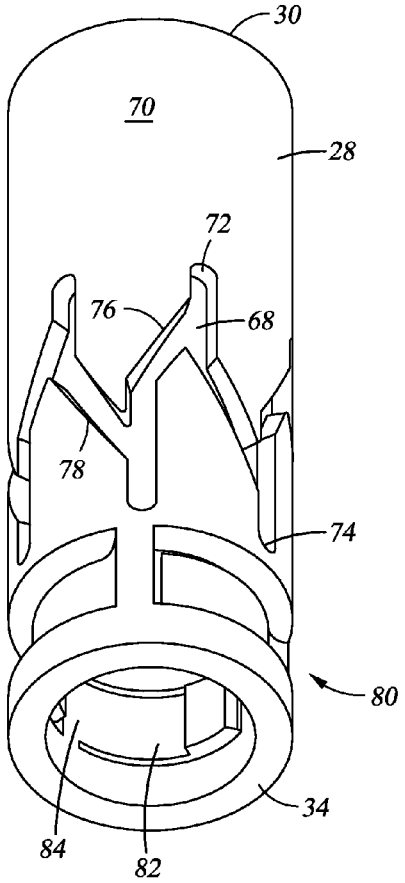
FIGS. 6A-6C depict views of an exemplary embodiment of a rotational collet for use in the downhole system.
Figure 6B:
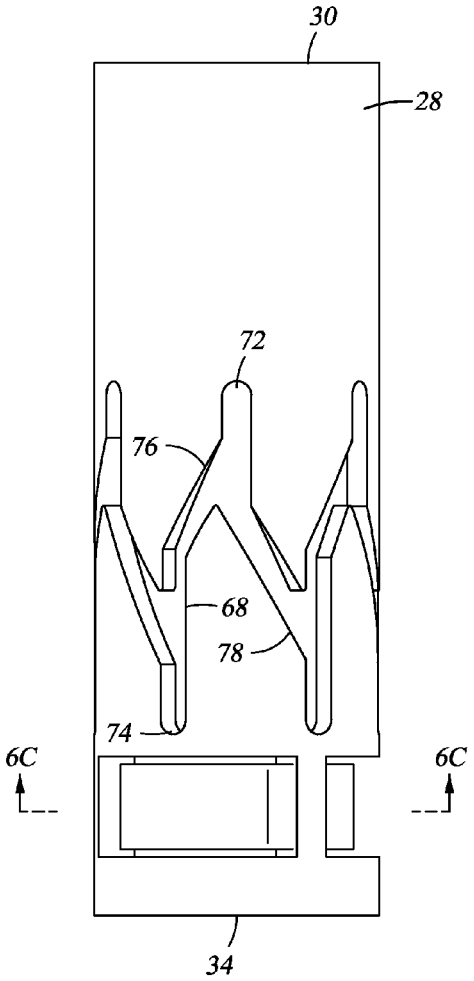
Figure 6C:
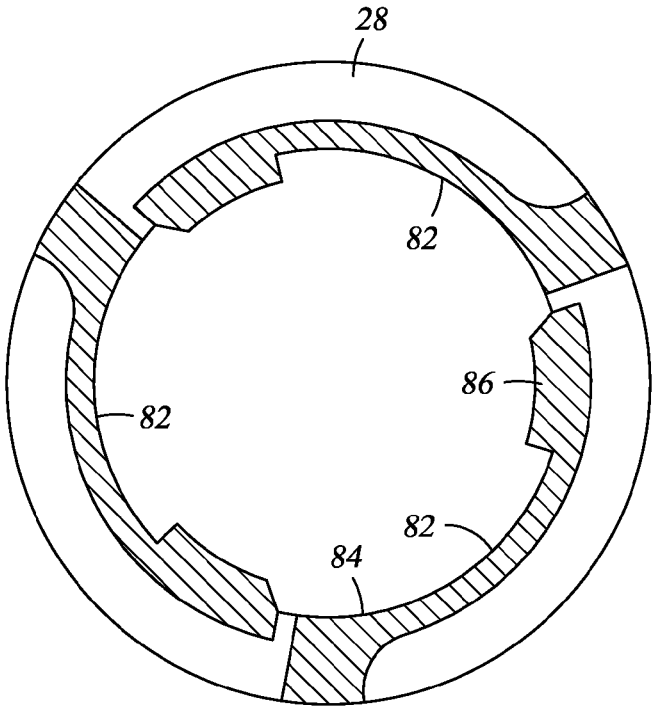
Figure 7:
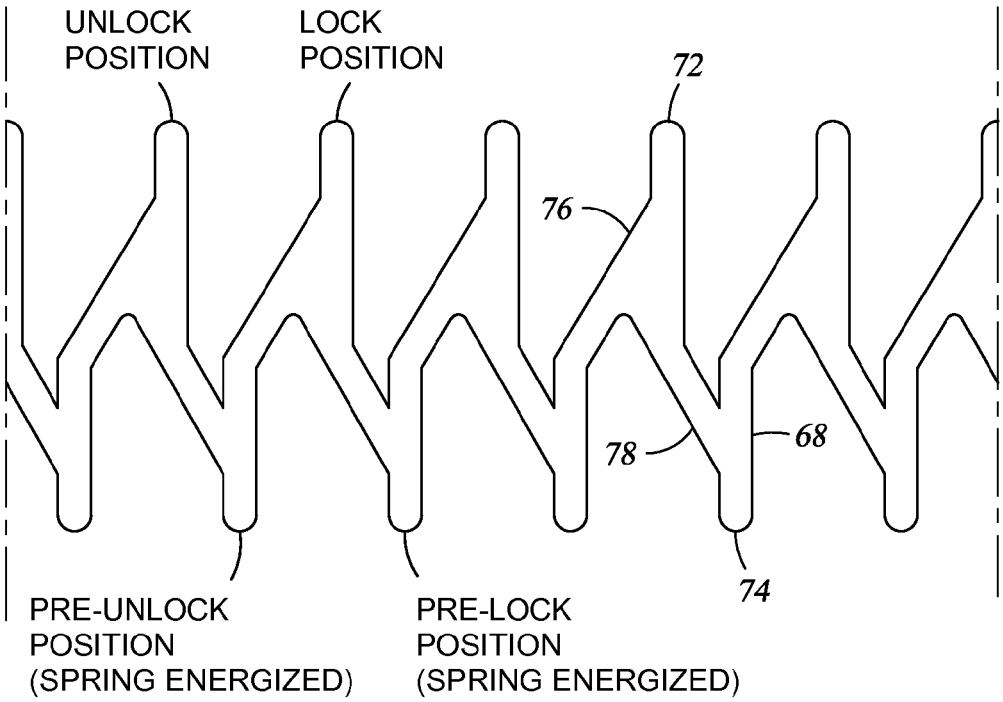
FIG. 7 depicts an exemplary embodiment of a j-track, illustrated in an flattened condition, for use on the rotational collet; and, FIGS. 8A-8B depict views of an exemplary embodiment of an indicating collet for use in the downhole system.

FIGS. 6A-6C show an exemplary embodiment of the rotational collet 28 in more detail. The uphole and downhole ends 30, 34 of the rotational collet 28 are shown, and the j-track 68 is shown indented in the exterior surface 70 of the rotational collet 28. The j-track 68 is shown in a flattened condition in FIG. 7. The j-track 68 is a continuous groove including a plurality of uphole and downhole portions 72, 74 interconnected by angled pathways 76, 78. Between the j-track 68 and the downhole end 34 of the rotational collet 28, a ring 80 of rotational collet fingers 82 is supported. Because the illustrated embodiment of the mandrel 16 for the downhole system 10 includes three detents 62 and three tracks 60, the rotational collet 28 includes three fingers 82. Each finger 82 extends around a peripheral portion of the rotational collet 28 and is supported for flexing radially with respect to the ring 80 via an integral hinge portion 84. Each finger 82 also includes a head portion 86 sized for receipt within the tracks 60 and detents 62. Flexing of the rotation collet fingers 82 is accomplished by rotational movement of the rotational collet 28 with respect to the mandrel 16. That is, the head portions 86 of the rotation collet fingers 82 will ride along the surfaces of the mandrel 16 in the ring-shaped portion 56 of the rotational collet finger receiving area 54, as will be further described below.

Figure 8A:
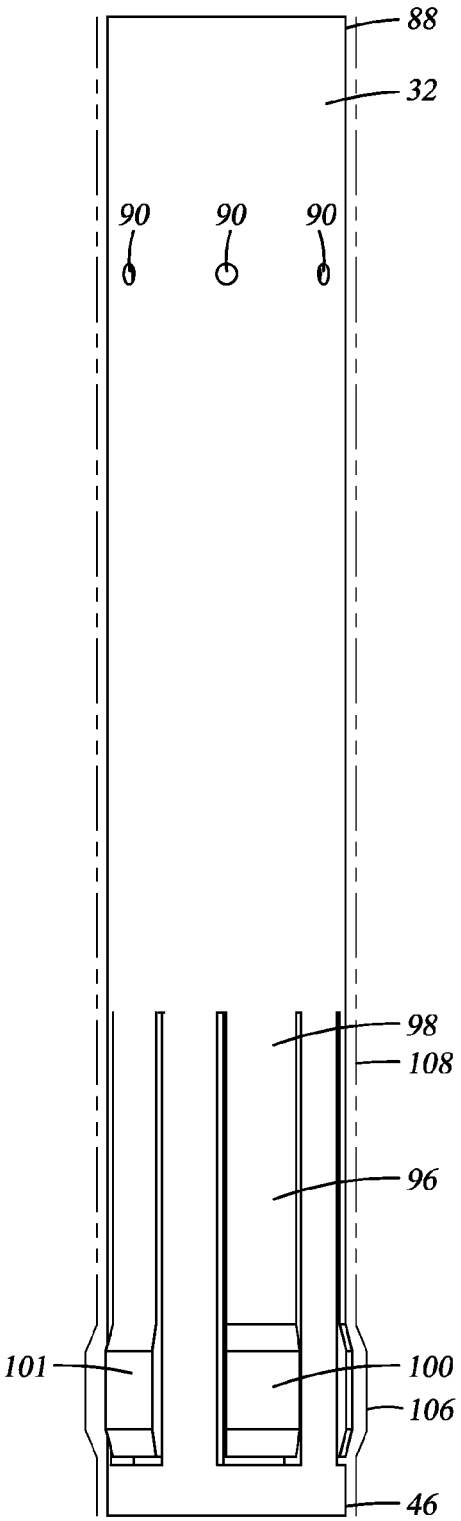
Figure 8B:
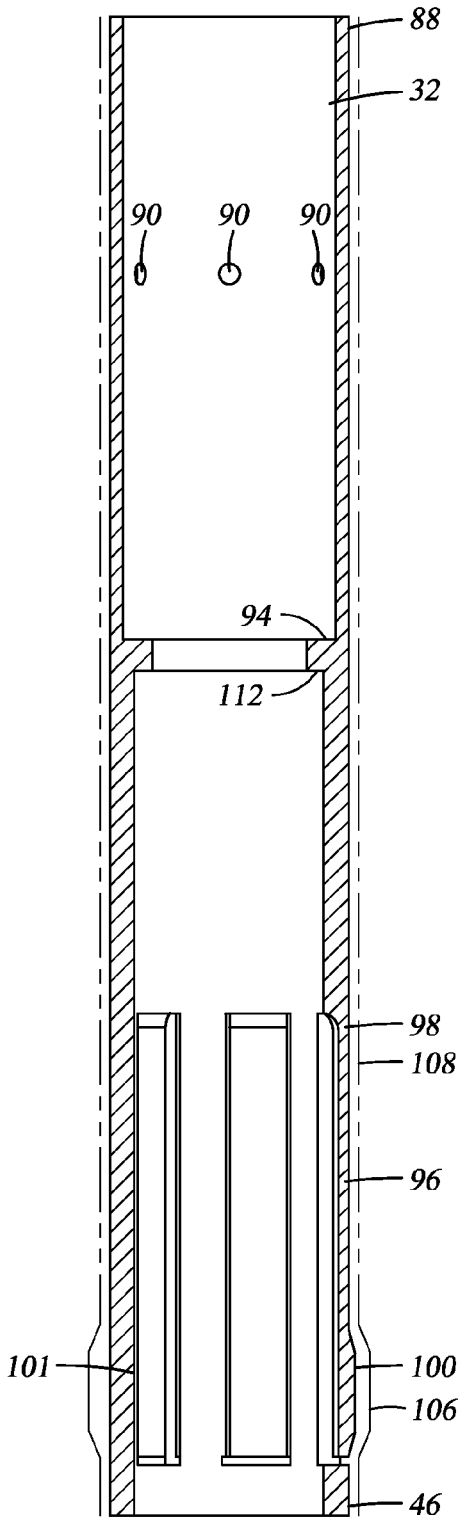

An exemplary embodiment of the indicating collet 32 is shown in more detail in FIGS. 8A-8B. The indicating collet 32 is generally cylindrical and includes the downhole end 46 and uphole end 88. A plurality of pin apertures 90 are provided for receiving pins 92 (FIG. 1E) for receipt within the j-track 68 of the rotational collet 28. Downhole of the pin apertures 90 is an internal shoulder 94 to abut with the downhole end 34 of the rotational collet 28 when the downhole system 10 is in the unlocked and locked positions, as shown in FIGS. 1C and 3A. Downhole of the internal shoulder 94 is a plurality of axially extending indicating collet fingers 96. Each finger 96 extends parallel to the longitudinal axis 14 and is supported for flexing radially via an integral hinge portion 98. Each finger 96 includes a head 100 which includes an outer profile 101 suited for receipt within a mating profile 106 in an outer string 108, shown schematically in FIGS. 8A and 8B. The indicating collet 32 is longitudinally movable with respect to the mandrel 16, and the collet fingers 96 are movable radially inward with respect to the mandrel 16. When the downhole system 10 is moved within the outer string 108, the outer profile 101 of the head 100 of the fingers 96 may engage with a mating profile 106. With the head 100 temporarily "stuck" in the mating profile 106, an uphole force applied to the mandrel 16 will compress the spring 38 and cycle the rotational collet 28. As the fingers 96 are not radially supported internally, additional force will release the heads 100 of the fingers 96 from the mating profile 106.

Figure 2A:
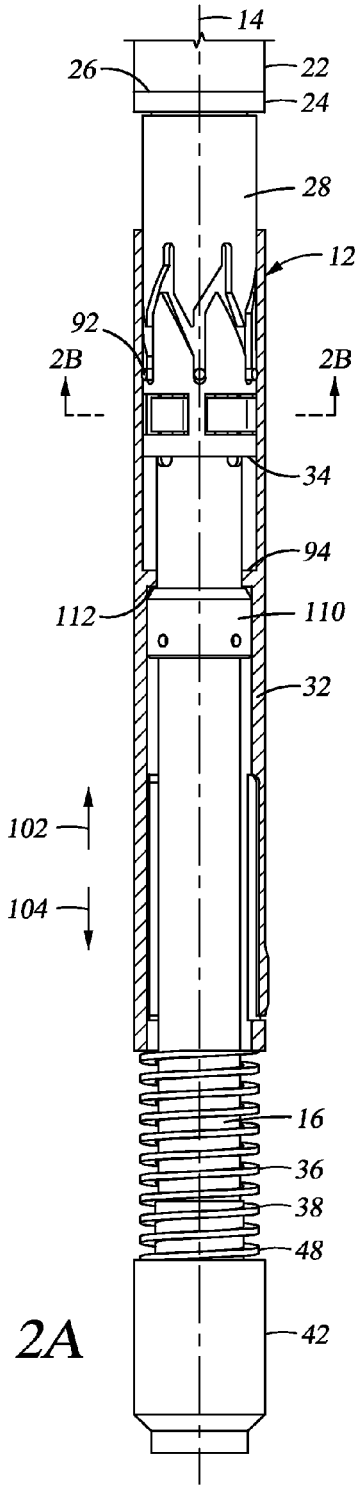
FIGS. 2A-2B depict views of the exemplary downhole system in a pre-locked position.
Figure 1B:
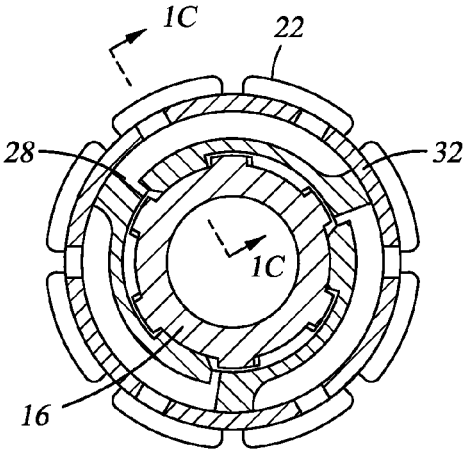
Figure 2B:
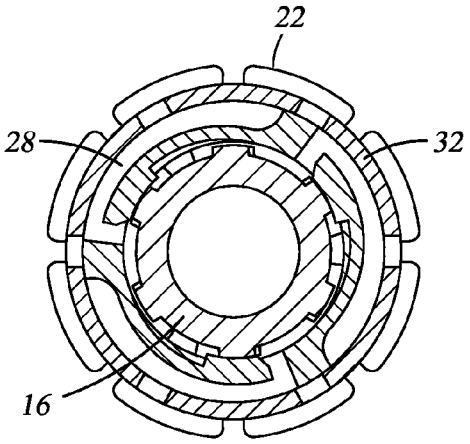
Figure 3B:
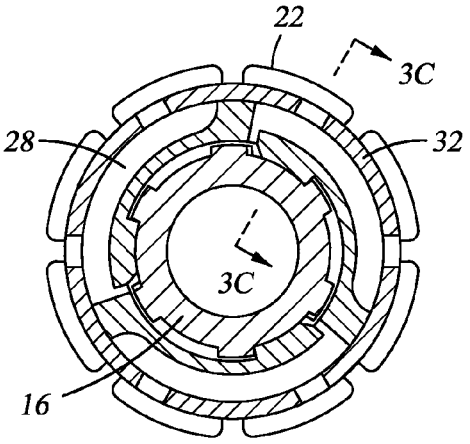
FIGS. 3A-3C depict views of the exemplary downhole system in a locked position.
Figure 4B:
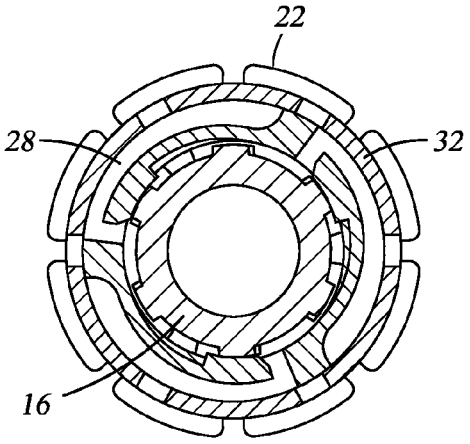
FIGS. 4A-4B depict views of the exemplary downhole system in a pre-unlocked position.
Figure 1C:
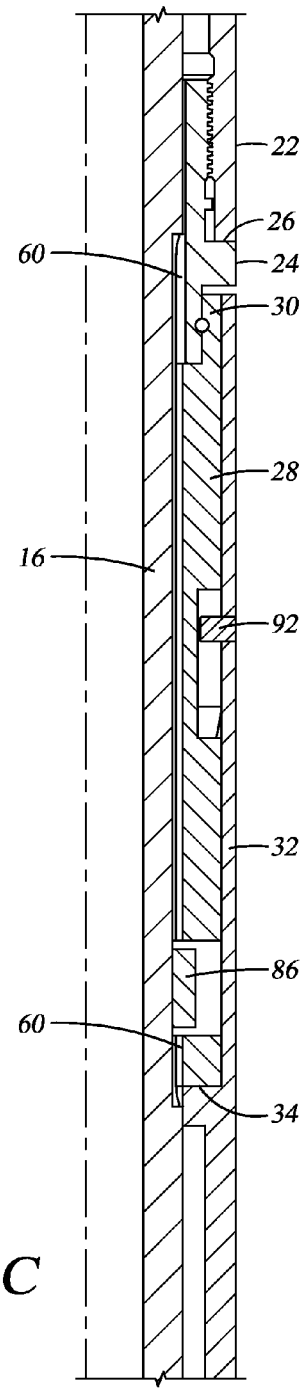
Figure 3C:
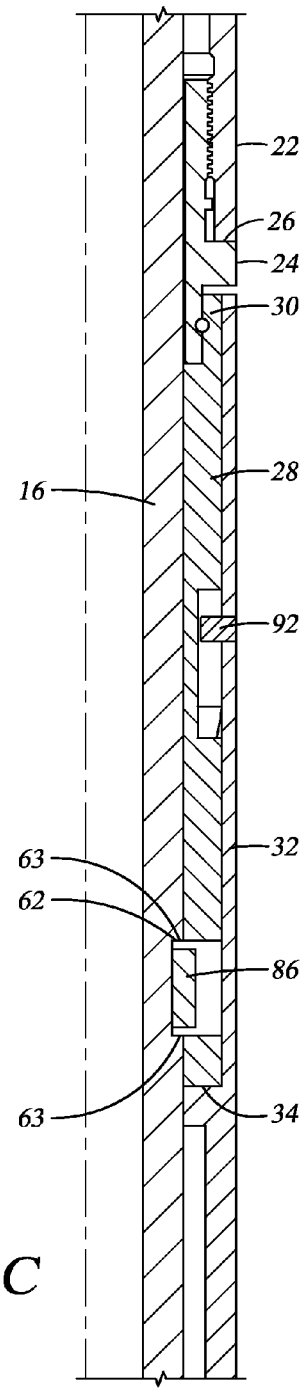
Figure 3A:
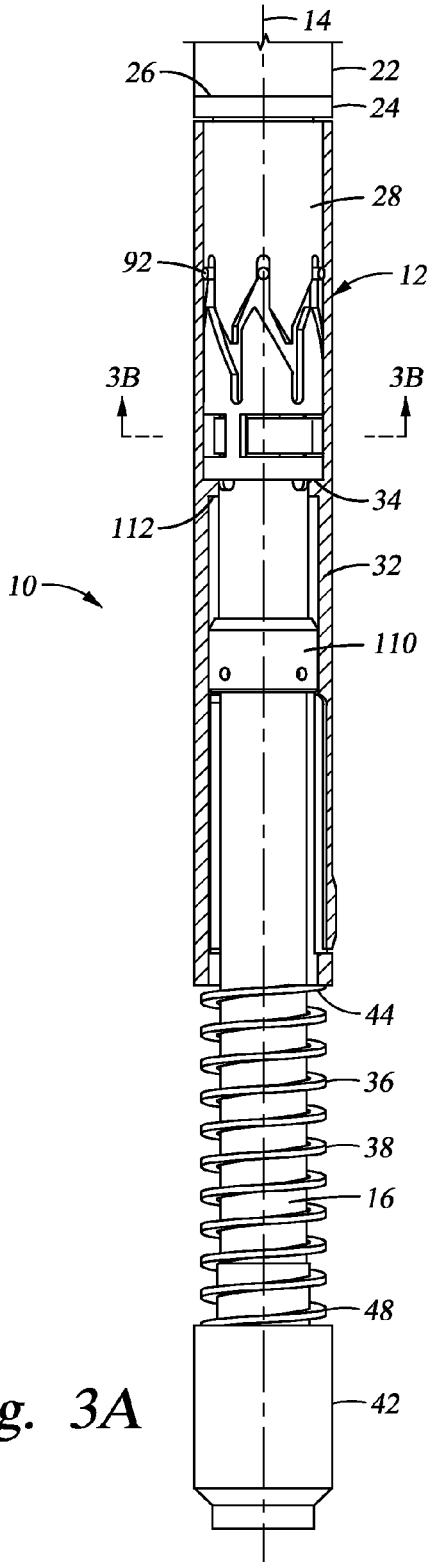

Reference will now be made to FIGS. 1-4, in which the views of FIGS. 1A-1C depict the unlocked position of the downhole system 10, the views of FIGS. 2A-2B depict the pre-locked position of the downhole system 10, the views of FIGS. 3A-3C depict the locked position of the downhole system 10, and the views of FIGS. 4A-4B depict the pre-unlocked position of the downhole system 10. In the unlocked position, the head portion 86 of the rotational collet fingers 82 will be received in the unlocked position tracks 60 and the mandrel 16 is permitted to move longitudinally with respect to the indicating tool 22 such that the use of the indicating tool 22 is "unlocked" and can be used to perform an indicating function. To move from the unlocked position shown in FIGS. 1A-1E to the pre-locked position shown in FIGS. 2A-2B: Uphole movement of the downhole system 10 in uphole direction 102 through at least one indicating profile 106 (FIGS. 8A and 8B) on an inner diameter of an outer string 108 forces indicating collet 32 (mandrel 16 moves longitudinally in the uphole direction 102 with respect to the indicating collet 32) to compress and energize spring 38 and cycles rotational collet 28 via j-track 68 interaction. Cycling of j-track 68 causes rotation of the rotational collet 28, which snaps fingers 82 out of mandrel tracks 60 and onto lands 64. Thus, when the profiled indicating collet 32 is latched into a mating profile 106 on the inner diameter of the outer string 108, via uphole movement, the indicating collet 32 will be pulled down, compressing the spring 38 and cycling the rotational collet 28 to the "pre-locked position" through j-track 68 interaction with pins 92 held in the indicating collet 32.

To move from the pre-locked position shown in FIGS. 2A-2B to the locked position shown in FIGS. 3A-3C: After the indicating collet 32 has snapped out of the indicating profile 106, spring force will shift indicating collet 32 in the uphole direction 102 until shouldering on the rotational collet 28, and cycle the rotational collet 28 via j-track 68 interaction. Cycling of j-track 68 will snap the rotational collet fingers 82 into the mandrel detents 62. Thus, after passing through the indicating profile 106, the spring 38 will cycle the rotational collet 28 up to the locked position. As can be seen in FIG. 3C, in the locked position, the mandrel 16 is not movable with respect to the indicating tool 22 because the detent wall 63 is blocked by the head portion 86 of the fingers 82. The locked position can be associated with a "snap thru mode" of the indicating tool 22.

To move from the locked position shown in FIGS. 3A-3C to the pre-unlocked position shown in FIGS. 4A-4B: Uphole tool movement through indicating profile 106 forces indicating collet 32 to compress and energize spring 38 and cycles rotational collet 28 via j-track 68 interaction. Cycling of j-track 68 snaps rotational collet fingers 82 out of lower mandrel detents 62 and onto lands 64.

To move from the pre-unlocked position shown in FIGS. 4A-4B to unlocked position shown in FIGS. 1A-1C: After indicating collet 32 has snapped out of indicating profile 106, spring force will shift indicating collet 32 in an uphole direction 102 until shouldering on the rotational collet 28, and cycle the rotational collet 28 via j-track 68 interaction. Cycling of j-track 68 will snap the rotational collet fingers 82 into the mandrel tracks 60.

Thus, this invention provides a selective locking apparatus 12 to selectively lock indicating tools 22 in the "snap thru mode" while tripping both in and out of the lower completion, for use in downhole applications.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A selective locking apparatus for an indicating tool, the selective locking apparatus comprising:

a mandrel having a rotational collet finger receiving area including a plurality of unlocked-position tracks alternatingly arranged with a plurality of locked-position detents;

a rotational collet rotatably supported on the mandrel, the rotational collet including a j-track on an outer periphery of the rotational collet, the rotational collet further including a plurality of rotational collet fingers having heads engageable within the rotational collet finger receiving area of the mandrel;

an indicating collet supported on the mandrel, the indicating collet including a plurality of indicating collet fingers; and, at least one pin fixedly mounted on the indicating collet for receipt within the j-track of the rotational collet;

wherein longitudinal movement of the mandrel with respect to the indicating collet cycles the rotational collet via j-track interaction and selectively places the heads of the rotational collet fingers into either the plurality of unlocked-position tracks or the plurality of locked-position detents.

2. The selective locking apparatus of claim 1, wherein, when the heads of the rotational collet fingers are seated within the plurality of unlocked-position tracks, the mandrel is longitudinally movable with respect to the rotational collet.

3. The selective locking apparatus of claim 1, wherein, when the heads of the rotational collet fingers are seated within the plurality of locked-position detents, the mandrel is longitudinally immovable with respect to the rotational collet.

4. The selective locking apparatus of claim 1, wherein the rotational collet finger receiving area of the mandrel further includes a plurality of raised lands interposed between the plurality of unlocked-position tracks and the plurality of locked-position detents.

5. The selective locking apparatus of claim 4, wherein the plurality of unlocked-position tracks extend longitudinally past a ring-shaped portion of the rotational collet finger receiving area, and the plurality of lands and the plurality of locked-position detents are within the ring-shaped portion of the rotational collet finger receiving area.

6. The selective locking apparatus of claim 1 wherein the heads of the rotational collet fingers are configured to snap into either the plurality of unlocked-position tracks or the locked-position detents.

7. The selective locking apparatus of claim 1 wherein the plurality of unlocked-position tracks is alternatingly arranged circumferentially with the plurality of locked-position detents about the mandrel.

8. A selective locking apparatus for an indicating tool, the selective locking apparatus comprising:

a mandrel having a rotational collet finger receiving area including a plurality of unlocked-position tracks alternatingly arranged with a plurality of locked-position detents;

a rotational collet rotatably supported on the mandrel, the rotational collet including a j-track on an outer periphery of the rotational collet, the rotational collet further including a plurality of rotational collet fingers having heads engageable within the rotational collet finger receiving area of the mandrel;

an indicating collet supported on the mandrel, the indicating collet including a plurality of indicating collet fingers; and, at least one pin fixedly mounted on the indicating collet for receipt within the j-track of the rotational collet; and a biasing device mounted at an end of the indicating collet, the biasing device biasing the indicating collet towards the rotational collet;

wherein longitudinal movement of the mandrel with respect to the indicating collet cycles the rotational collet via j-track interaction and selectively places the heads of the rotational collet fingers into either the plurality of unlocked-position tracks or the plurality of locked-position detents.

9. The selective locking apparatus of claim 8 wherein the biasing device is a spring.

10. The selective locking apparatus of claim 9, wherein longitudinal movement of the mandrel with respect to the indicating collet compresses the spring or releases the spring.

11. The selective locking apparatus of claim 8, wherein, when an outer profile of the indicating collet fingers is received within a mating profile in an outer string, longitudinal movement of the mandrel with respect to the indicating collet energizes the biasing device.

12. A selective locking apparatus for an indicating tool, the selective locking apparatus comprising:

a mandrel having a rotational collet finger receiving area including a plurality of unlocked-position tracks alternatingly arranged with a plurality of locked-position detents, the plurality of unlocked-position tracks and the plurality of locked-position detents indented into an outer surface of the mandrel;

a rotational collet rotatably supported on the mandrel, the rotational collet including a j-track on an outer periphery of the rotational collet, the rotational collet further including a plurality of rotational collet fingers having heads engageable within the rotational collet finger receiving area of the mandrel;

an indicating collet supported on the mandrel, the indicating collet including a plurality of indicating collet fingers; and, at least one pin fixedly mounted on the indicating collet for receipt within the j-track of the rotational collet;

wherein longitudinal movement of the mandrel with respect to the indicating collet cycles the rotational collet via j-track interaction and selectively places the heads of the rotational collet fingers into either the plurality of unlocked-position tracks or the plurality of locked-position detents.

13. A downhole system comprising:

the selective locking apparatus of claim 1; and, an indicating tool;

wherein the indicating tool is supported by the mandrel.

14. The downhole system of claim 13, wherein the mandrel is movable with respect to the indicating tool when the heads of the rotational collet fingers are positioned within the plurality of unlocked-position tracks, and the mandrel is locked with respect to the indicating tool when the heads of the rotational collet fingers are positioned within the plurality of locked position detents.

15. A method of selectively locking an indicating tool, the method comprising:

attaching the selective locking apparatus of claim 1 to the indicating tool, wherein the mandrel of the selective locking apparatus supports the indicating tool.

16. The method of claim 15, further comprising:

moving the mandrel longitudinally with respect to the indicating collet to energize a biasing device supported on the mandrel and cycle the rotational collet to position the rotational collet fingers within either a pre-locked position or a pre-unlocked position with respect to the rotational collet finger receiving area of the mandrel; and, de-energizing the biasing device to cycle the rotational collet and position the rotational collet fingers within either a locked position or an un-locked position.

17. The method of claim 16, further comprising engaging the indicating collet fingers with a mating profile in an outer string, prior to moving the mandrel longitudinally with respect to the indicating collet.

18. The method of claim 17, wherein de-energizing the biasing device includes disengaging the indicating collet fingers with the mating profile.

19. The method of claim 15, wherein the indicating tool is unlocked when the heads of the rotational collet fingers are positioned within the plurality of unlocked-position tracks and the indicating tool is locked when the heads of the rotational collet fingers are positioned within the plurality of locked-position detents.

20. The method of claim 19, wherein the mandrel is longitudinally movable with respect to the indicating tool when the heads of the rotational collet fingers are positioned within the plurality of unlocked-position tracks.

* * * * *